US007439436B2

(12) United States Patent
Sakurai

(10) Patent No.: US 7,439,436 B2
(45) Date of Patent: Oct. 21, 2008

(54) MAIN CASE BODY OF MUSICAL KEYBOARD INSTRUMENT

(75) Inventor: Yuji Sakurai, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 177 days.

(21) Appl. No.: 11/315,538

(22) Filed: Dec. 21, 2005

(65) Prior Publication Data

US 2006/0137508 A1 Jun. 29, 2006

(30) Foreign Application Priority Data

Dec. 28, 2004 (JP) ..... 2004-382084

(51) Int. Cl.
*G10C 3/12* (2006.01)

(52) U.S. Cl. ..... 84/423 R; 84/177

(58) Field of Classification Search ..... 84/423 R, 84/177, 178

See application file for complete search history.

(56) References Cited

U.S. PATENT DOCUMENTS 4,914,999 A * 4/1990 Masubuchi et al. ..... 84/423 R

* cited by examiner

*Primary Examiner*—Walter Benson
*Assistant Examiner*—Jianchun Qin
(74) *Attorney, Agent, or Firm*—Morrison & Foerster LLP

(57) ABSTRACT

A main case body of a musical instrument, which is capable of securing a degree of freedom of design. A case structure includes a lower front case, a lower rear case, and an upper case. The lower front case has a keyboard unit mounted therein. A bottom part extends in a front-rear direction of the lower front case. A key supporting part is formed such that it rises from the rear of the bottom part of the lower front case and extends in the key arrangement direction. A stopper body for stopping a free end of each key is formed such that it rises from the front of the bottom part of the lower front case and extends in the key arrangement direction. A battery case is formed by six battery terminal-associated parts arranged side by side for batteries between the key support part and the stopper body.

6 Claims, 3 Drawing Sheets

MAIN CASE BODY OF MUSICAL KEYBOARD INSTRUMENT

BACKGROUND OF THE INVENTION

1. Field of the Invention

The present invention relates to a main case body of a musical keyboard instrument, such as an electronic musical keyboard instrument, and more particularly to a main case body of a musical keyboard instrument that has an improved battery case and a keyboard unit.

2. Description of the Related Art

A conventional technique related to a battery case of a musical keyboard instrument has been disclosed e.g. in Japanese Utility Model Publication (Kokoku) No. H07-43943. In this conventional technique, a battery accommodating section having a box shape elongated in the key arrangement direction (key arranged direction) is formed in a lower case of a musical keyboard instrument, and a plurality of-pairs of elastic pieces are formed on the bottom of the battery accommodating section in a manner arranged in the key arrangement direction, to thereby prevent occurrence of play and rattle of batteries (cells).

A musical keyboard instrument generally has a structure in which a key supporting part that supports keys and a stopper body that limits the range of stroke of each key extend in the key arrangement direction in parallel with each other, and hence it is preferred that a battery case is formed between the key supporting part and the stopper body. In the aforementioned conventional technique as well, the battery accommodating section is formed between the key supporting part and the stopper body. In this conventional technique, however, the battery accommodating section is formed into the box shape elongated in the key arrangement direction, as mentioned above. In other words, the battery accommodating section has a structure in which a plurality of batteries are arranged lengthwise in the key arrangement direction. In this case, if a battery lid extending over the entire length of all the batteries arranged lengthwise is formed, it is easy to take in and out the batteries. However, the battery lid having a length corresponding to the entire length of all the batteries tends to be lower in mounting rigidity, and hence a slightest shock due to a fall of the lower case can cause breakage of a battery lid stopper and throw out the batteries. To avoid this problem, the battery lid is often formed to have a length corresponding to the length of one battery or one battery and a half. In this case, however, a plurality of batteries have to be inserted lengthwise from a small opening for which the lid is provided, and hence it is difficult to insert them. Further, since the batteries are arranged lengthwise, space between the electrodes of two adjacent batteries becomes so narrow that it is difficult to put a finger into the space so as to take out the batteries.

Furthermore, the most serious problem is that since the long box-shaped battery accommodating section occupies a long space at least in the key arrangement direction. Therefore, it is difficult to avoid interference between the battery accommodating section and many other parts, resulting in a very low degree of freedom in the design of the instrument. For example, when a mold for a part of the lower case-side of a keyboard unit is shared between different models of the musical keyboard instrument, it is required to change the design of the battery accommodating section (battery case) itself in a manner adapted to the shared mold.

SUMMARY OF THE INVENTION

It is an object of the present invention to provide a main case body of a musical keyboard instrument, which is capable of securing a degree of freedom of design of a battery case thereof.

To attain the above object, the present invention provides a main case body of a musical keyboard instrument having a keyboard unit in which a plurality of keys arranged in a predetermined key arrangement direction, the main case body constructing a case structure of the musical keyboard instrument with at least one sub case body, the main case body comprising a bottom part extending in a front-rear direction of the main case body, a key supporting part formed such that the key supporting part rises from a rear part of the bottom part of the main case body and extends in the predetermined key arrangement direction, the key supporting part supporting each of the keys of the keyboard unit at a base end of the key, a stopper body formed such that the stopper body rises from a front part of the bottom part of the main case body and extends in the predetermined key arrangement direction, the stopper body stopping a free end of each of the keys of the keyboard unit when the key is operated, and a battery case including a plurality of battery terminal-associated parts arranged side by side for batteries between the key supporting part and the stopper body.

With the arrangement of the present invention, the battery case has a structure in which a plurality of battery terminal-associated parts are arranged side by side such that a plurality of batteries can be juxtaposed side by side, so that at least the width of the battery case in the key arrangement direction can be made far more compact than in the case where batteries are arranged lengthwise in the key arrangement direction. This makes it possible to suppress interference between the battery case and other members below the keyboard unit. Further, a space occupied by the battery case below the keyboard unit in the key arrangement direction becomes so small that a degree of freedom of design is secured. For example, when it is necessary to cut out several portions of the key supporting part to pass leads for connecting between a circuit board provided below the keyboard unit and a circuit board provided rearward of the key supporting part, an increased number of cutouts can be formed in the key arrangement direction, which makes it possible to share a lower case (main case body) with the same specification between different models of the musical keyboard instrument.

Preferably, the plurality of battery terminal-associated parts are juxtaposed in a direction along lengths of the key supporting part or the stopper body.

With the arrangement of this preferred embodiment, the longitudinal direction of each battery is perpendicular to the key arrangement direction. Therefore, when the bottom of the battery case is formed into a wave shape by arranging arcuate surfaces each conformable to the columnar surface of a battery in a side-by-side fashion, the axes of the respective arcuate surfaces are perpendicular to the key arrangement direction, which increases rigidity of the main case body against bending forces applied to the axis thereof in the front-rear direction. Further, since the battery case has the structure in which batteries are arranged side by side (in parallel) in the key arrangement direction, even when the voltage used in a musical keyboard instrument is changed, it is not required to largely modify a mold for molding the main case body. Particularly when the number of batteries is to be increased, it is only required to secure a space corresponding to the total lateral width of the batteries between the key supporting part and the stopper body, which makes it easy to change the design.

Preferably, the battery case is provided at a location corresponding to an accompaniment section of the keyboard unit.

With the arrangement of this preferred embodiment, the battery case is provided at a location corresponding to the accompaniment section (low-pitched sound side) of the keyboard unit. In general, a plurality of keys in the accompaniment section are operated simultaneously for performance, and therefore forces are frequently applied to the accompaniment section by key depression. However, the structure of the battery case provided in this frequently used part of the main case body contributes to an increased rigidity of the main case, which makes it possible to secure a strength of the same for withstanding the applied forces.

Preferably, at least one wall rib is provided between the key supporting part and the stopper body in a manner intersecting the battery case in the predetermined key arrangement direction.

With the arrangement of this preferred embodiment, the at least one wall rib is formed in a manner intersecting the battery case in the key arrangement direction. Therefore, the rigidity of the main case against a bending force applied to the axis thereof in the key arrangement direction is enhanced.

Preferably, the bottom part, the battery case, the stopper body, and the plurality of battery terminal-associated parts which are made of a resin are formed integrally.

With the arrangement of this preferred embodiment, the bottom part, the battery case, the stopper body, and the plurality of battery terminal-associated parts which are made of a resin are formed integrally. Therefore, the main case body of the keyboard instrument can be produced easily.

More preferably, the wall rib and the battery case which are made of a resin are formed integrally.

With the arrangement of this preferred embodiment, the wall rib and the battery case which are made of a resin are formed integrally. Therefore, strength of the main case body can be increased.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the drawings showing a preferred embodiment thereof.

In the following description of a musical keyboard instrument and its case structure, directions indicated by "upper", "lower", "left", and "right" are those as viewed from the side of a player who is playing the instrument in the correct or normal position (i.e. as viewed from a keyboard unit side). Further, the player's side of the musical keyboard instrument will be referred to using "front" or "forward", while a rear panel side opposite to the player's side using "rear" or "rearward".

Figure 1:
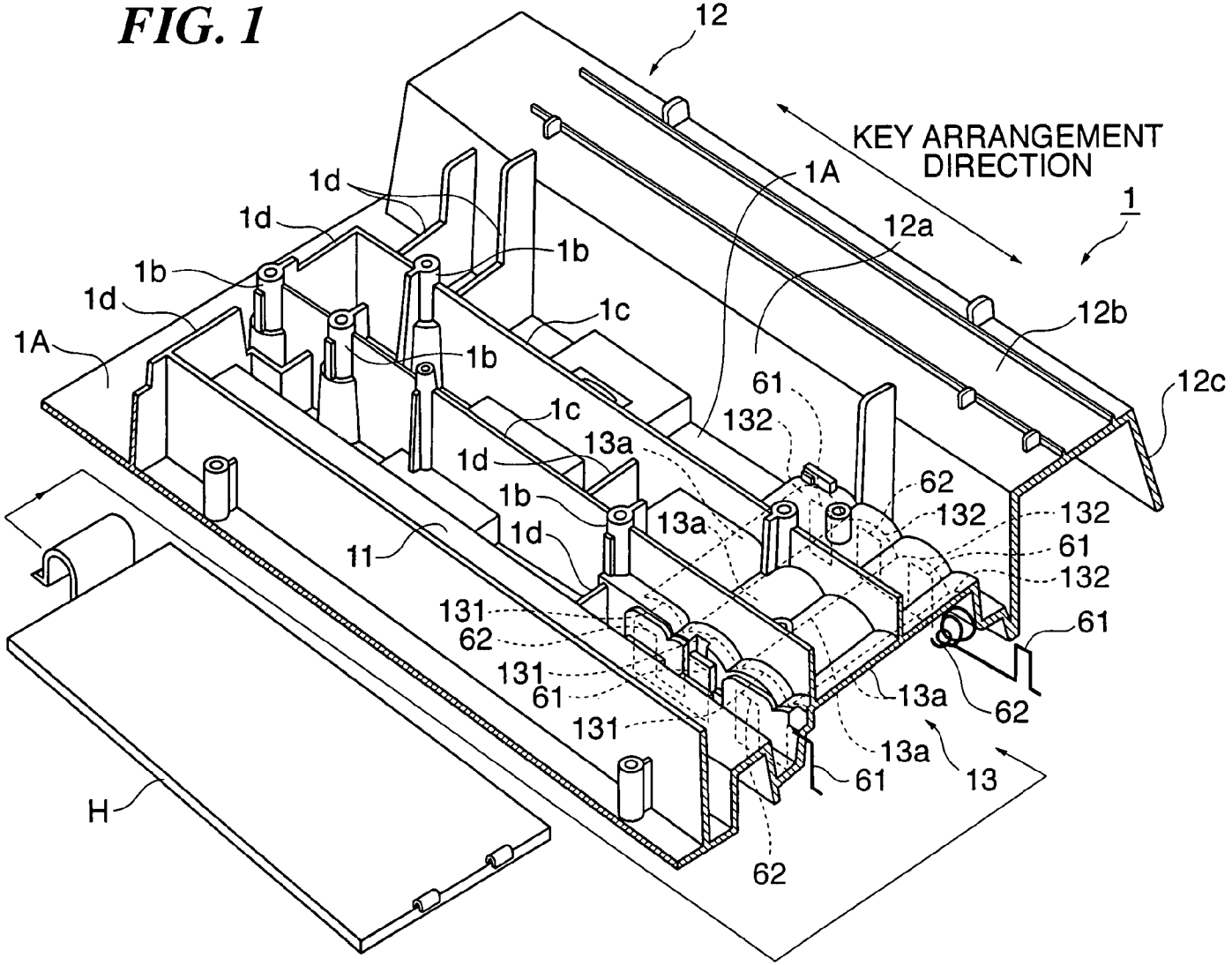
FIG. 1 is a cross-sectional perspective view showing a lower front case as a main case body of a musical keyboard instrument, according to an embodiment of the present invention.
Figure 2:
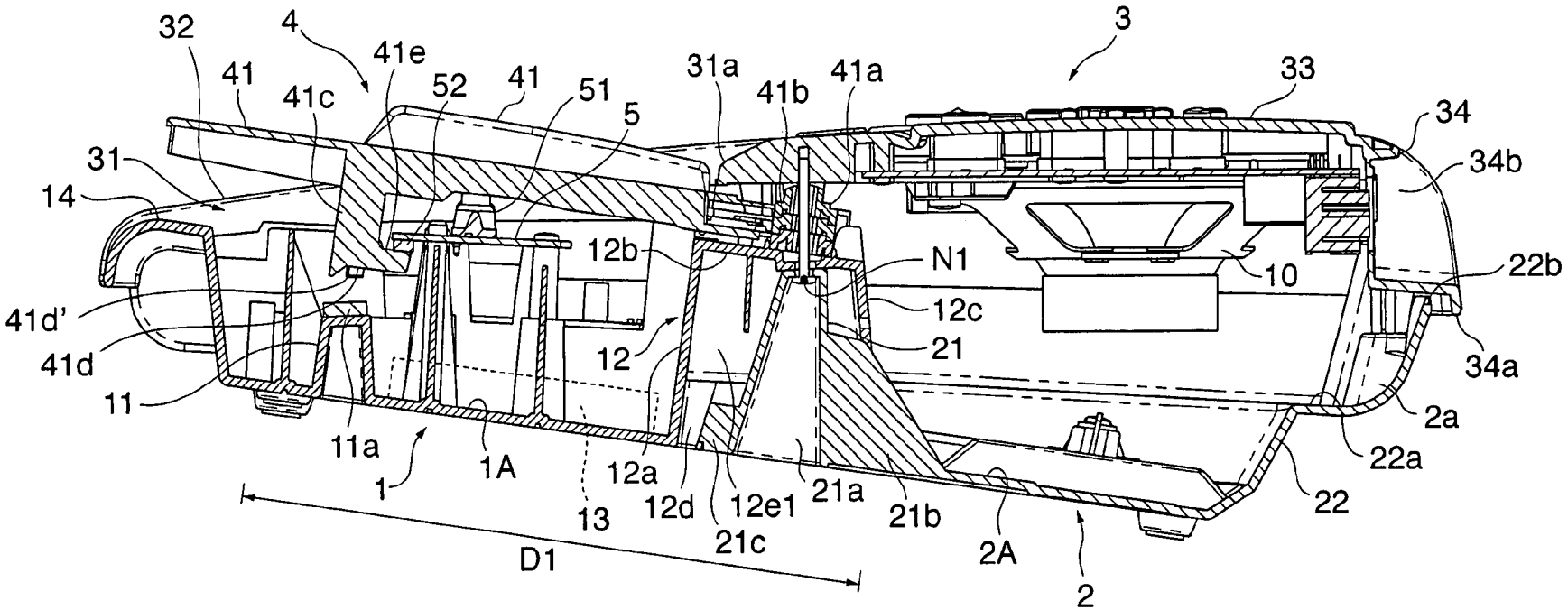
FIG. 2 is a side cross-sectional view of the musical keyboard instrument employing the lower front case.
Figure 3:
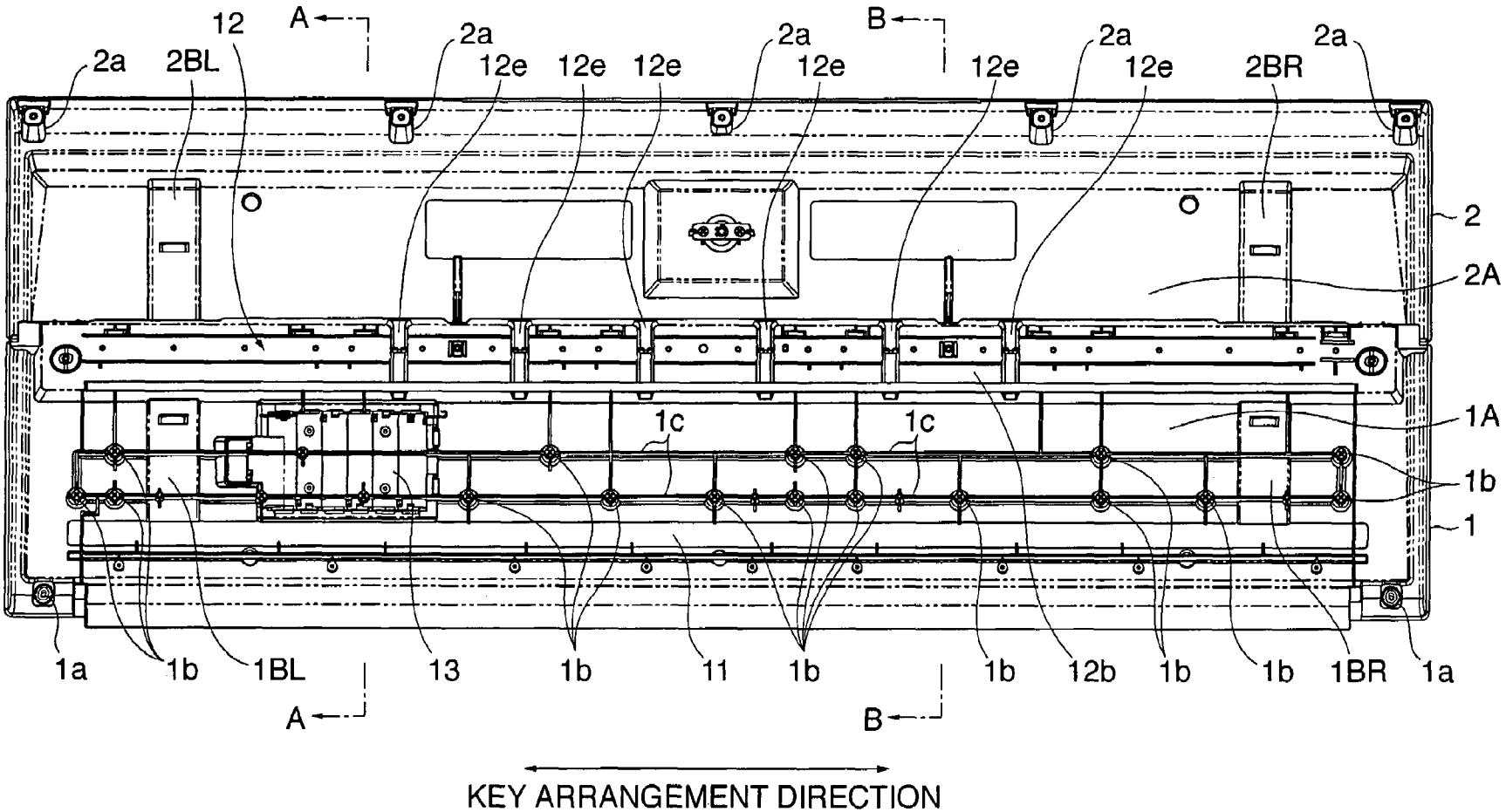
FIG. 3 is a plan view of a lower front case and a lower rear case of the musical keyboard instrument.

FIG. 1 is a cross-sectional perspective view showing a lower front case as a main case body of the musical keyboard instrument, according to the present embodiment. FIG. 1 shows a lower front case of the case assembly from which an upper case and the keyboard unit are removed, as viewed obliquely from a forward and up position. FIG. 2 is a side cross-sectional view of the musical keyboard instrument employing the lower front case. FIG. 3 is a plan view of the lower front case and a lower rear case of the musical keyboard instrument from which the upper case is removed, as viewed from above. It should be noted that a hatched sectional portion in FIG. 1 is a view taken on line A-A of FIG. 3 and corresponds to a portion designated by D1 in FIG. 2. FIG. 2 is a cross-sectional view taken on line B-B of FIG. 3.

As shown in FIG. 2, the case structure serving as the exterior of the musical keyboard instrument is comprised of three cases, i.e. the lower front case 1 as a "main case body", and a lower rear case 2 and an upper case 3 as "sub case bodies". These cases are produced by forming integrally respective components referred to hereinafter, which are made of a hard synthetic resin, using metal molds. The lower front case 1 has a stopper body 11 formed at a front part thereof such that the stopper body 11 rises from a bottom part 1A and defines a groove in the underside surface thereof. The stopper body 11 extends in the key arrangement direction over substantially the entire length of the musical keyboard instrument. The stopper body 11 has a cushion member 11*a* of felt or the like attached thereto. Hereafter, the stopper body 11 and the cushion member 11*a* is sometimes collectively referred to as "the stopper body", as deemed appropriate.

In the rear of the lower front case 1, there is formed a key supporting part 12 that supports base ends 41*a* of keys 41 of a keyboard unit 4. As shown in FIG. 2, the key supporting part 12 is formed by a front panel 12*a* rising from the bottom part 1A, a supporting panel part 12*b* continuously extending rearward from the upper end of the front panel 12*a*, and a rear panel 12*c* continuously extending downward from the rear end of the supporting panel part 12*b*. The key supporting part 12 extends in the key arrangement direction over substantially the entire length of the musical keyboard instrument. Thus, the key supporting part 12 is formed into a shape of an inverted gutter that opens downward. The key supporting part 12 has a plurality of rear case supporting projections 12*d* (see FIG. 2) formed on an opening side thereof such that the rear case supporting projections 12*d* project rearward from the front panel 12*a* and are juxtaposed in the key arrangement direction. Further, the key supporting part 12 has portions formed with respective wiring grooves 12*e* (see FIG. 3) each crossing the associated portion in a direction perpendicular to the key arrangement direction to form a deep groove recessed from the inside of the instrument toward the bottom part 1A side. In the present embodiment, the number of the wiring grooves 12*e* formed in the respective potions in a manner juxtaposed in the key arrangement direction is six. In FIG. 2, there is shown a wall surface 12*e*1 of the wiring groove 12*e*.

Between the stopper body 11 and the key supporting part 12 of the lower front case 1, there is formed a battery case 13, described in detail hereinafter, in a manner dented from the bottom part 1A toward the inside of the instrument. Further, as shown in FIGS. 2 and 3, the lower front case 1 has a front frame part 14 formed at a front end thereof such that the front frame part 14 rises from the bottom part 1A, projects forward, and is curved downward. The front frame part 14 extends in the key arrangement direction. It should be noted that the front frame part 14 is omitted in FIG. 1. Further, at opposite lateral sides of the front end of the lower front case 1, bosses 1*a* and 1*a* (see FIG. 3) each having a screw hole at a bottomed end thereof are formed as hollow projections such that they rise from the bottom part 1A toward the inside of the instrument.

As shown in FIG. 2, in the front part of the lower rear case 2, there are formed a plurality of main bosses 21 in parallel with each other at appropriate locations in the key arrangement direction. Each main boss 21 has a hollow 21*a* formed therein, and an opening thereof in a bottom part 2A is formed into an elliptical shape elongated in the front-rear direction. Although the main boss 21 and the hollow 21*a* defined therein have a generally triangular shape in FIG. 2, when viewed from the front, the top and the bottom of them have the same width if tapering for drawing is ignored. Further, a rib 21*b* projects rearward from the main boss 21 in a manner rising from the bottom part 2A, while a projection 21*c* projects forward from the main boss 21 such that it is brought into contact with an associated one of the rear case supporting projections 12*d* of the lower front case 1. The lower rear case 2 has a rear wall 22 rising from the rear end of the bottom part 2A in a substantially curved manner. The rear wall 22 is formed with a stepped portion 22*a*, and a plurality of bosses 2*a* (see FIG. 3) are formed at predetermined locations on the stepped portion 22*a* in the key arrangement direction. Each boss 2*a* is hollow from a bottom side thereof, and a bottomed end thereof is formed with a screw hole.

The upper case 3 has approximately the same width in the front-rear direction as the total width of the lower front case 1 and the lower rear case 2 in the front-rear direction, and has a key open part 31 provided as a space extending forward from an intermediate portion of the upper case 3, for exposing the keyboard unit 4. Cover parts 32 for covering the opposite end parts of the lower front case 1 are formed on the respective left and right sides of the key open part 31. A central rear end part 31*a* of the key open part 31 is in the vicinity of the front panel 12*a* of the key supporting part 12, and a portion of the upper case 3 extending rearward from the central rear end part 31*a* forms a panel surface 33. The upper case 3 is thus formed into a general U-shape in plan view as viewed from above. Further, the upper case 3 has a rear wall 34 formed at a rear end thereof in a manner generally curved downward. The rear wall 34 has a lowermost end 34*a* slightly projecting rearward of an uppermost end 22*b* of the rear wall 22 of the lower rear case 2 whereby the upper case 3 extends over the rear end of the lower rear case 2. It should be noted that the rear wall 34 of the upper case 3 is formed with a connection terminal opening 34*b* for exposing external connection terminals. Further, in the electronic musical instrument of the present embodiment, speakers 10 (see FIG. 2) are disposed on the inner surface of the upper case 3 at left and right locations laterally spaced from each other.

The keyboard unit 4 is mounted in the lower front case 1. The keyboard unit 4 has keys (white and black keys) 41 arranged in the key arrangement direction indicated by a double-headed arrow in FIG. 1 or 3, or in a direction perpendicular to the sheet of FIG. 2. The base ends 41*a* of the keys 41 are attached to the key supporting part 12 of the lower front case 1. Further, each key 41 is formed with an elastic sheet-like hinge part 41*b* extending from an associated one of the base ends 41*a*, whereby the key 41 can be pivotally moved substantially about the associated base end 41*a*. An intermediate portion of the key 41 slightly closer to its front end is formed with an L-shaped stopper abutment piece 41*c* extending downward. The lower end of the stopper abutment piece 41*c* serves as a lower abutment part 41*d*, and the upper surface of a projection projecting rearward from the lower end of the stopper abutment piece 41*c* serves as an upper abutment part 41*e*. In FIG. 2, the lower abutment part 41*d* is a part of a white key, and a lower abutment part 41*d* is a part of a black key.

On an intermediate portion of the lower front case 1 in the key arrangement direction, there are erected a plurality of substrate mounting bosses 1*b* at respective predetermined locations in a manner spaced from each other in the front-rear direction, and a circuit board 5 having key switches 51 (see FIG. 2) etc. provided thereon is fixed to the respective upper ends of the substrate mounting bosses 1*b*. When the key 41 is depressed counterclockwise, as viewed in FIG. 2, the lower abutment part 41*d* of the stopper abutment piece 41*c* is brought into abutment with the cushion member 11*a* of the stopper body 11, thereby setting a lower limit position to a key stroke. Then, when released, the key 41 is pivotally moved clockwise, as viewed in FIG. 2, by the restoring resilient force of the hinge part 41*b*, to bring the upper abutment part 4*e* of the stopper abutment piece 41*c* into abutment with a cushion member 52 on the underside surface of the circuit board 5, whereby the key 41 returns to a state shown in FIG. 2, thus setting an upper limit position to the key stroke. It should be noted that each key switch 51 on the circuit board 5 detects key-on, key-off, initial touch, and so forth, according to key operations performed by depressing and releasing the key 41 associated with the key switch 51.

The present electronic musical instrument is assembled as follows. The base ends 41*a* of the keyboard unit 4 are positioned on the supporting panel part 12*b* of the key supporting part 12 of the lower front case 1 using a positioning means, not shown, and are mounted thereon. Then, the main bosses 21 of the lower rear case 2 are inserted into the gutter of the key supporting part 12, and the respective upper ends of the main bosses 21 are brought into contact with the underside surface of the supporting panel part 12*b* of the key supporting part 12. At the same time, the projections 21*c* projecting forward from the respective main bosses 21 of the lower rear case 2 are brought into contact with the respective rear case supporting projections 12*d* of the lower front case 1. Next, the upper case 3 is placed on the lower front case 1 and the lower rear case 2, and the lower front case 1 and the lower rear case 2 are screwed to the upper case. 3 via the left and right bosses la and la on the front end of the lower front case 1 and the bosses 2*a* on the rear end part of the lower rear case 2. Although not shown, the upper case 3 has screwing bosses formed at respective locations corresponding to the bosses la and 2*a*, respectively. Then, screws N1 are inserted from the hollows 21*a* of the respective main bosses 21. At this time, each screw N1 is inserted through a slot formed in each base end 41*a* of the associated keys 41. Then, the screws N1 are screwed to the inner surface of the upper case 3. Thus, the keyboard unit 4 is fixed to the key supporting part 12. It should be noted that the central rear end part 31*a* of the key open part 31 of the upper case 3 and the panel surface 33 extending rearward from the central rear end part 31*a* cover the hinge parts 41*b* and base ends 41*a* of the keys 41 and component parts, not shown, accommodated in the lower rear case 2.

As shown in FIG. 3, the battery case 13 of the lower front case 1 is configured to contain six AA batteries, and is formed as a case having a rectangular shape of approximately 90 mm×55 mm in plan view. The battery case 13 is formed between the stopper body 11 and the key supporting part 12, and located in a left-side part of the lower front case 1, as viewed from the player's position in front of the keyboard unit 4. Further, between the stopper body 11 and the key supporting part 12, two wall ribs 1*c* elongated in the key arrangement direction are erected on the bottom part 1A, such that the two wall ribs 1*c* connect the substrate mounting bosses 1*b* provided therein. Furthermore, a plurality of ribs 1*d* are erected on the bottom part 1A such that they extend perpendicular to the wall ribs 1*c*. The elongated wall ribs 1*c* intersect the battery case 13. The battery case 13 has a plurality of battery fitting recesses 13*a*, 13*a*, . . . for accommodating a plurality of (six, in the illustrated example) batteries, respectively. Each of the battery fitting recesses 13*a*, 13*a*, . . . has an arcuate surface as a part of a columnar shape corresponding to the side shape of a battery. It should be noted that the battery case 13 is closed from the bottom side by a battery lid H as shown in FIG. 1. The battery lid H has an opposed surface opposed to all the batteries when the battery case 13 is closed, so that when the battery case 13 is opened, all the batteries are exposed, which facilitates the mounting and removal of the batteries.

As shown in FIG. 1, each battery fitting recess 13*a* has a stopper body-side end thereof and a key supporting part-side end thereof functioning as battery terminal-associated parts 131 and 132, respectively, and hence the battery terminal-associated parts 131 adjacent to each other and the battery terminal-associated parts 132 adjacent to each other are arranged side by side, respectively. In other words, the battery fitting recesses 13*a* has a structure in which batteries are arranged side by side. Further, in the present embodiment, the battery terminal-associated parts 131 and 132 are juxtaposed along the lengths of the key supporting part 12 and the stopper body 11, and each battery is disposed with its longitudinal axis oriented in the direction orthogonal to the key arrangement direction. The battery terminal-associated parts 131 and 132 have positive electrode-side terminals 61 associated with the positive electrodes of batteries and negative electrode-side terminals 62 associated with the negative electrodes of the batteries. These terminals 61 and 62 are formed of elastic conductive wire. The positive electrode-side terminal 61 is formed into a U-shape, and the negative electrode-side terminal 62 is formed into a spring-like shape. It should be noted that although broken lines in FIG. 1 provide a schematic illustration of the corresponding part of the battery case 13, the positive electrode-side terminal 61 and the negative electrode-side terminal 62 of adjacent batteries which are connected schematic via the terminals 61, 62 to each other are integrally formed with each other.

As described above, the battery case 13 has the structure in which a plurality of batteries are arranged side by side, so that at least the width of the battery case 13 in the key arrangement direction can be made far more compact than in the case where batteries are arranged lengthwise in the key arrangement direction. Now, the wiring grooves 12*e* appearing in FIG. 3 are for routing leads from the circuit board 5 to a main circuit board, not shown, in the lower rear case 2. On the other hand, a space occupied by the battery case 13 below the circuit board 5 in the key arrangement direction is much reduced. Therefore, five of the six wiring grooves 12*e* in FIG. 3 are in direct communication with the space between the stopper body 11 and the key supporting part 12 (i.e. below the circuit board 5). This facilitates not only wiring for the circuit board 5, but also routing of leads from the circuit board 5 into the wiring grooves 12*e*. Further, many wiring grooves 12*e* can be easily utilized, which makes the lower front case 1 easy to use in different models and makes it possible to secure a degree of freedom of design.

Further, in the present embodiment, the battery case 13 has the structure in which batteries are arranged side by side, and as shown in FIG. 1, the bottom of the battery case 13 has a wave shape formed by arranging arcuate surfaces side by side. Therefore, the axes of the respective arcuate surfaces extend perpendicular to the key arrangement direction, which increases the rigidity of the lower front case 1 against a bending force applied to the axis of the lower front case 1 in the front-rear direction. Further, since the battery case 13 is provided at a location corresponding to a left-side accompaniment section (low-pitched sound side) of the keyboard unit 4, even if forces are frequently applied by key depression e.g. for accompaniment during musical performance, the high rigidity of the battery case 13 makes it possible to ensure strength thereof for withstanding the forces.

Further, even when the present embodiment is applied to another model with a voltage changed, it is not required to largely modify a mold for metal molding. Furthermore, it is possible to increase the number of batteries to be arranged in the key arrangement direction between the key supporting part 12 and the stopper body 11, as desired.

It should be noted that in the present embodiment, leg fitting parts 1BL and 1BR each elongated in the front-rear direction and dented from the bottom part 1A toward the inside of the lower front case 1 are formed at respective locations close to the opposite lateral ends of the lower front case 1. Further, as shown in FIG. 3, leg fitting parts 2BL and 2BR each dented from the bottom part 2A toward the inside of the lower rear case 2 are formed at respective locations close to the opposite lateral ends of the lower rear case 2 in line with the respective leg fitting parts 1BL and 1BR. The instrument body can be supported by legs, not shown, fitted in the leg fitting parts 1BL and 2BL and the leg fitting parts 1BR and 2BR, respectively. Further, in the present embodiment, since the wall ribs 1*c* and 1*c* are formed such that they intersect the battery case 13 in the key arrangement direction, the rigidity of the instrument against bending forces applied to the axis thereof in the key arrangement direction is increased. Therefore, even when the instrument body is supported at the leg fitting parts 1BL, 2BL, 1BR, and 2BR in a bridging fashion, it is possible to play the instrument with stability realized by the high rigidity thereof. Although in the above described embodiment, the wall ribs 1*c* and 1*c* intersect the battery case 13, this is not limitative.

There are various restrictions on space below the keyboard unit which are imposed concerning not only the leg fitting parts 1BL and 1BR, but also the switch substrate, key stoppers on the opposite side of the key supporting part, key guides, etc. However, according to the present embodiment, since the batteries are arranged side by side, it is possible to eliminate the restrictions without difficulty.

Although in the present embodiment, the batteries are laterally arranged side by side in the key arrangement direction, this is not limitative, but the batteries may be arranged side by side in a direction different from the key arrangement direction so long as the battery case 13 has a structure in which batteries are arranged side by side between the stopper body 11 and the key supporting part 12.

Further, although in the present embodiment, the case assembly is comprised of three cases, i.e. the lower front case 1, the lower rear case 2, and the upper case 3, this is not limitative, but the case assembly may be comprised of only two cases, i.e. a lower case and an upper case, or may be constructed otherwise.

In the present embodiment, the bottom part 1A, the battery case 13, the stopper body 11, and the plurality of battery terminal-associated parts 131, 132 which are made of a resin are formed integrally, whereby the lower front case 1 can be produced easily. Moreover, the key supporting part 12 and the front lower case 1 may be formed integrally using metal molds.

Further, in the present embodiment, the wall ribs 1*c*. the ribs 1*d* and the battery case 13 which are made of a resin are formed integrally, whereby strength of the lower front case 1 can be increased.

What is claimed is:

1. A main case body of a musical keyboard instrument having a keyboard unit in which a plurality of keys arranged in a predetermined key arrangement direction, the main case body constructing a case structure of the musical keyboard instrument with at least one sub case body, the main case body comprising:

a bottom part extending in a front-rear direction of said main case body;

a key supporting part formed such that said key supporting part rises from a rear part of said bottom part of said main case body and extends in the predetermined key arrangement direction, said key supporting part supporting each of the keys of the keyboard unit at a base end of the key;

a stopper body formed such that said stopper body rises from a front part of said bottom part of said main case body and extends in the predetermined key arrangement direction, said stopper body stopping a free end of each of the keys of the keyboard unit when the key is operated; and a battery case that accommodates a plurality of batteries between said key supporting part and said stopper body such that a longitudinal direction of the accommodated batteries and a longitudinal direction of the keys of said keyboard unit are parallel to each other, said battery case including therein a plurality of battery terminal-associated parts arranged at both ends of said battery case with respect to the longitudinal directions of the keys.

2. A main case body as claimed in 1, wherein said plurality of battery terminal-associated parts are juxtaposed in a direction along lengths of said key supporting part or said stopper body.

3. A main case body as claimed in 1, wherein said battery case is provided at a location corresponding to an accompaniment section of the keyboard unit.

4. A main case body as claimed in 1, wherein at least one wall rib is provided between said key supporting part and said stopper body in a manner intersecting said battery case in the predetermined key arrangement direction.

5. A main case body as claimed in 4, wherein said wall rib and said battery case which are made of a resin are formed integrally.

6. A main case body as claimed in 1, wherein said bottom part, said battery case, said stopper body, and said plurality of battery terminal-associated parts which are made of a resin are formed integrally.

* * * * *